United States Patent [19]

Weir et al.

[11] 4,389,066

[45] Jun. 21, 1983

[54] RESCUE UNIT

[75] Inventors: Roy Weir, 1638 Dalton Rd., Timmins, Ontario, Canada, P4N 7C2; Larry G. Morin; Louis D. Guenette, both of Sturgeon Falls, Canada

[73] Assignee: Roy Weir, Timmins, Canada

[21] Appl. No.: 237,819

[22] Filed: Feb. 25, 1981

[30] Foreign Application Priority Data

Nov. 7, 1980 [CA] Canada ..... 364324

[51] Int. Cl.[3] ..... A61G 3/00

[52] U.S. Cl. ..... 296/19; 296/20; 296/24 R; 280/12 R; 280/12 S; 280/24

[58] Field of Search ..... 296/19, 20, 24 R; 280/12 R, 128, 18, 19, 24, 15

[56] References Cited

U.S. PATENT DOCUMENTS

| | | | |
|---|---|---|---|
| D. 216,784 | 3/1970 | Martinmaas | D12/14 |
| D. 229,929 | 1/1974 | Haskins | D23/14 |
| 2,203,909 | 6/1940 | Insam | 280/15 |
| 2,232,643 | 2/1941 | Smith | 280/12 R |
| 2,299,993 | 10/1942 | Kirk | 280/15 |
| 2,456,024 | 12/1948 | Schofield | 296/19 |
| 2,770,465 | 11/1956 | Dandurand | 280/15 |
| 3,578,378 | 5/1971 | Anderson | 296/100 |
| 3,580,592 | 5/1971 | Schrecengost | 280/20 |
| 3,603,419 | 7/1971 | Riddle | 280/18 |
| 3,746,357 | 7/1973 | Haskins | 280/15 |

FOREIGN PATENT DOCUMENTS 38911 9/1969 Canada .

OTHER PUBLICATIONS

Sno-Cruiser by General Aluminum Products, Inc.

*Primary Examiner*—Robert R. Song

*Attorney, Agent, or Firm*—Sughrue, Mion, Zinn, Macpeak and Seas

[57] ABSTRACT

A rescue unit adapted to be towed by a snow mobile or the like includes a frame and attached skis. A patient support section is carried by the frame and includes a movable cover. An attendant support section is also carried on the frame longitudinally spaced from the head of a patient carried on the patient support section. The cover preferably includes first and second portions, the first portion being hingedly connected with one side of the frame and limited in its opening movement. The second cover portion is telescopically movable with respect to the first cover portion, and preferably has a transparent section for viewing the head of a patient being carried on the unit.

16 Claims, 4 Drawing Figures

RESCUE UNIT

FIELD OF THE INVENTION

This invention relates to rescue sleighs and more particularly to rescue sleighs adapted to be pulled by traction vehicles such as snowmobiles for the purpose of rescue and transport of a patient who cannot be reached by more conventional methods due to climatic conditions or limited access. However, the invention not only provides a means of transport for an injured or ill person but also provides a means of transporting trained personnel and medical equipment to the scene of an accident. The apparatus is adaptable to provide these services on a marine environment or bush environment as circumstances dictate. In the former case the snow skis suspension is appropriately modified for a wheel assembly. To use the unit for marine rescue, the suspension and skis may be removed and the sleigh positioned on a boat. The apparatus could be lifted and transported by a helicopter in certain emergency situations in order to provide medical equipment at the scene of an accident.

BACKGROUND OF THE INVENTION

Over the past few decades, people, and society generally, have become more dependent on advanced modes of transportation. One of the more significant developments, particularly in the last thirty years have been "off-road" vehicles, particularly of the snowmobile and "all terrain" variety.

With the increased participation of people in outdoor winter sports such as snowmobiling, snowshoeing and cross country as well as downhill skiing, the need of equipment specifically for rescue and providing equipment related thereto, has significantly increased. The incidences of accidents and illnesses in areas not accessible to conventional vehicles has also increased.

The snowmobile has provided and continues to provide increased flexibility in the movement of people during winter months, both in recreational pursuits as well as in areas of employment related to forestry, timber cutting and trapping. However the unpredictability of the weather generally and in particular, devastating snowstorms in areas not previously known to be hard hit, has heightened concern for emergency rescue means which are capable of providing patient rescue and transport from places of work or residences when such people cannot be reached or transported by more conventional modes of transportation.

Snowmobile sleighs have been provided in the past for recreational purposes but they are not suited to or adequate in providing facilities for the rescue and transportation of a seriously injured or sick person. Although rescue sleighs have been proposed for towing with a snowmobile, they have not been of a design and structure where constant surveillance of a patient is available and may be maintained, the patient is readily accessible at all times, treatment may be administered in transport and a significant amount of rescue and treatment equipment may be carried.

SUMMARY OF THE INVENTION

Accordingly, the invention herein seeks to provide a rescue unit which is designed and constructed to carry certain pieces of equipment which provide for medical treatment of a patient comparable to that possible with conventional ambulances. The sleigh particularly provides for the possibility of an attendant at the patient's head, to the rear of the unit, which attendant is in constant contact with the patient and is able to observe him closely. Treatment, if necessary, can be rendered by the attendant even in transit.

Accordingly the invention seeks to provide a relatively compact, fully equipped and manual unit, operational under conditions that prove restrictive to existing rescue vehicles, a unit which is adapted to transport medical and rescue equipment and personnel to a scene of an accident under such restrictive conditions; and a unit capable of transporting a patient in a controlled environment while receiving treatment with a relatively smooth ride and under constant observation by an attendant, a choice of positioning of the patient ranging from fully recumbent to seating as well as prone or semi-prone as may be dictated by the condition or preference of the patient.

The invention in a broad aspect pertains to a rescue unit adapted to be towed by a vehicle comprising a frame and transport assembly means such as skis attached to the frame. The unit has a patient support section carried by the frame which section has a cover selectively movable to an open position to permit access to the patient support system. An attendance, support section is carried on the frame and is longitudinally spaced from the patient support section in the direction of the head of a patient carried on the patient support section.

Preferably the cover means includes two portions, one portion being hingedly connected to one side of the frame. The second portion is telescopingly movable with respect to the first cover portion.

Other aspects and advantages of the invention will become apparent from the detailed description of a preferred embodiment of the invention set forth herein in conjunction with the drawings appended hereto.

DETAILED DESCRIPTION OF PREFERRED EMBODIMENTS

Figure 1:
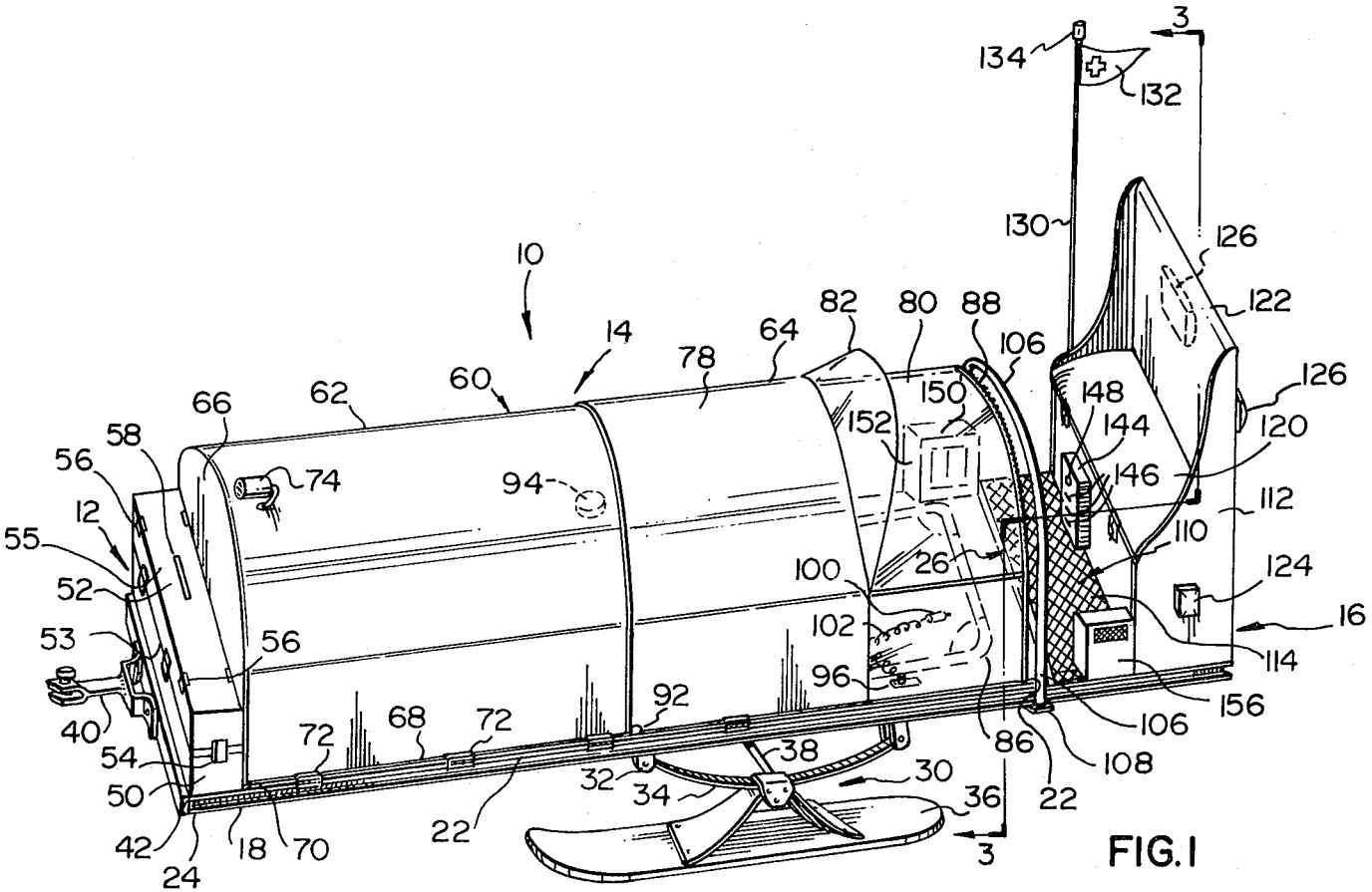
FIG. 1 is a front perspective view of a rescue unit illustrating the preferred embodiment of the invention.

As shown in FIG. 1, the preferred embodiment of the invention provides a sleigh 10 having essentially three sections, the hitch or towbar section 12, the patient or patient carrying section 14 and an attendant's section 16.

The sleigh 10 includes two spaced, longitudinally extending frame members 18, 20 preferably aluminum "I" beams. To the top of the beams is secured, by suitable means such as bolt means, a flat frame support 22 such as a plywood board insulated by ½" styrofoam and covered with canvas. The support 22 extends from the forward end 24 of the frame members 18, 20 to a point 26 between the patient section 14 and the attendant's section 16. Suitable cross bar means between the frame members 18, 20 may be used to increase the strength and rigidity of the sleigh frame.

Attached to each frame member 18, 20 is a ski assembly generally designated as 30. Each assembly 30 is secured at its upper ends to the respective frame member by suitable pivotal and movable bolt assemblies 32. Each assembly 30 further includes leaf spring means 34 and skis 36. The skis 36 are pivotally mounted about cross bar axle 38 and are effectively suspended independently of each other through the respective suspension assembly. The skis 36 may be made of aluminum. The position of the skis relative to the ends of the frame members 18 and 20 is such that when a patient and attendant are riding on the sleigh, there is minimal vertical weight transferred to the rear of the towing snowmobile through the hitch section 12.

Hitch or towbar section 12 includes a towbar or hitch means 40 which is secured to the frame members 18, 20 by suitable cross bar means 42 and attendant bolt means (not shown). Hitch means or towbar 40 provides easy attachment to a complementary hitch means of a snowmobile through usual operative means (not shown). Hitch means 40 is of steel or other suitable material and would include a safety chain for the usual purposes in the towing art.

Supported on top of one another and on the forward portion of frame members 18, 20 are two oxygen bottle storage structures or boxes 50, 52. Lower storage structure 50 is permanently secured by suitable means (not shown) to frame members 18, 20. The lid (not shown) for structure 50 is supported and recessed into the top of structure 50 but it is not otherwise secured to structure 50. About the top peripheral edge of structure 50 and extending upwardly thereabove a short distance is ridge means 53 into which structure 52 removably sits. Upper storage structure 52 is removably or detachably secured to lower structure 50 by suitable clip means 54, one at each end of the structures 50 and 52. Upper structure 52 has a hinged top 55 with suitable clasp means 56 for securing it closed. Structure 52 also has handle means 58 for carrying it. Structures 50 and 52 are similar in length and width but structure 52 is slightly greater in height to provide for additional equipment. Both structures 50, 52 are adapted to carry oxygen bottles (Size E), the upper 52 being easily removed from its attachment to lower structure 50 to enable carriage by hand to a patient as circumstances dictate. Also included in upper structure 52 are appropriate oxygen masks, tubing, regulators and oral airways and other airway related first aid equipment. Lower structure 50 carries a spare oxygen bottle.

Figure 2:
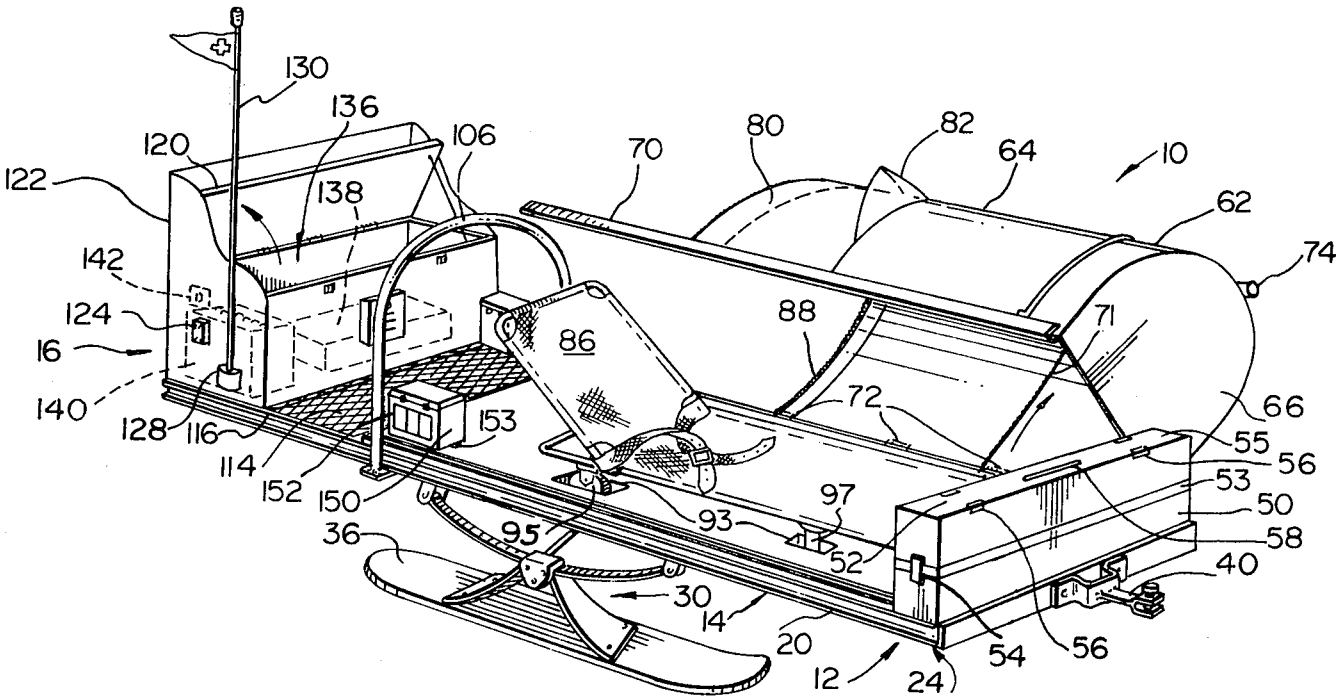
FIG. 2 is a front perspective view of the rescue unit from the opposite side showing the cover and seat respectively hinged in their open positions.

Patient (or intermediate section) 14 includes a hinged canopy or cover member 60 comprised of two sections, a forward or foot section 62 and a rear or head section 64. Forward section 62 has closed end 66 immediately adjacent to structures 50, 52, and is open at its other end. Along each lower side edge 68 of section 62 is a longitudinally extending track or channel 70 which extends laterally outwardly and upwardly slightly from the side edges. It will be noted that channel 70 extends rearwardly of section 62. One side edge 68 of forward section 62, including the associated channel 70, is hingedly connected to frame support 22, four hinge means 72 being shown. With section 64 slidably received and associated with side channel 70 of section 60 and therefore both sections hinged by hinge means 72, both sections, as shown in FIG. 2 may be moved upward thereby opening the sleigh and providing full access to support section 14 for loading and unloading a stretcher and a patient thereon. Canopy 60 is held open by its own gravity but restricted to a degree of opening by chain means 71 between the canopy 60 and support 22. On the upper forward portion of section 62 is horn means 74 for attracting the attention of the operator of a snowmobile towing the rescue sleigh as will be more fully noted hereinafter.

Section 64 of canopy 60 has a lower end adjacent section 62 and comprises portions 78 and 80, portion 78 being of similar configuration and material to section 62 whereas portion 80, although having a configuration somewhat similar to portion 78 is of transparent plastic material, such as Lexan® with windscreen 82 of similar transparent plastic material extending upwardly adjacent the junction of portions 78 and 80. Section 64 is slidably received on side channels 70 and in retracted position shown in FIG. 2, overlaps section 62. In its extended position section 62 in conjunction with section 64 substantially covers frame support 22 and any patient reclining on stretcher means 86. The rear end of transparent portion 80 is open but around the periphery of the rear end are zipper means 88 to which may be attached a canvas cover (not shown) to provide selective closure of the end. The lower edges of slidable section 64 are adapted for travel in channels 70 and include roller means 92 whereby section 64 may be telescoped relative to section 62.

Section 62 and portion 78 of section 64 are of similar construction of sheet aluminum over a suitable frame, section 64 being slightly larger to provide suitable telescoping action between the sections 62 and 64. The inside of section 62 is preferably insulated with about ½" styrofoam covered in carpeting attached in a suitable manner. The inside of portion 78 of section 64 is covered in suitable carpeting. Within section 62 at its rearward end is an interior dome light 94 to be referred to further herein.

As previously noted, portion 80 of section 64 as well as windscreen 82 are of transparent plastic material and may be sheets of the material suitably formed and attached to a frame or molded to the particular shape desired. The transparent construction of portion 80 enables an attendant to see a patient on stretcher 86 even when section 64 is in its fully extended position. As previously noted, hinging of cover member 60 through hinges 72 attached to forward section 62 as shown in FIG. 2 permits easy access to a patient being carried on stretcher 86 on frame support 22 and facilitates loading and unloading a patient and stretcher 86 onto sleigh 10. Moreover, the telescoping of section 64 and 62 permits the back of stretcher 86 to be raised so that a patient may be conveniently carried in a sitting position as circumstances dictate. It should be appreciated that although rollers 92 are provided on the forward portion of the lower edge of section 64 to ease telescoping movement of section 64 relative to section 62, there is sufficient frictional contact between other portions of the lower edges of section 64 with part of channels 70 and the surface of support 22 that the slidable section 64 does not readily slide on its own. Nevertheless it will be appreciated that fastening means (not shown) may be provided to secure slidable section 64 in any one of a number of desired telescoped positions relative to the frame support 22 and section 62.

As shown in FIG. 2, the upper surface of frame support 22 has recesses 93 adapted to receive wheels 95 and legs 97 of stretcher 86. The stretcher 86 is not otherwise attached to sleigh 10 and is held in place by gravity. Nevertheless it will be appreciated that fastening means (not shown) may be provided to secure stretcher 86 to sleigh 10.

Section 14 also has adjacent one side of support 22 and generally flush therewith (FIG. 1) an electrical (female) socket 96 into which an electric heating mattress may be plugged, the mattress would normally be built into a sleeping bag for a patient. This mattress effectively operates on 12 volt current and is optionally controlled by a switch on a control unit to be referred to further herein.

Further, section 14 has a patient call button means 100 located at the end of flexible tubing 102 and wired to the control unit to be referred to herein. The call button 100, as will be more fully appreciated herein, allows a patient being carried on the sleigh to attract the attention of the attendant over the noise of a snowmobile engine.

Rearward of patient section 14 is attendant section 16 having a safety bar or handrail 106 for an attendant. Bar 106 is secured at each end to respective frame members 18, 20 by suitable means including brackets 108 attached to the frame members 18, 20.

Attendant section 16 has a footrest 110 and seat means 112. Foot rest 110 comprises a heavy steel mesh sheet 114 framed by steel flat bars 116 attached to the top flange of "I" beam frame members 18, 20.

Seat means 112 include seat 120 and back rest 122 of plywood construction, both preferably padded and covered with durable weatherproof vinyl or other environmental suitable material. On each side of seat means 112 is an orange light 124 and on the back of the seat means 122 there are two red taillights 126. Removably secured to one side of seat means 112 through brackets 128 is antenna 130 carrying flag 132 and having light means 134 at its upper end. Antenna 130 may be unscrewed from bracket 128.

Seat 120 is hinged to the frame of seat means 112 whereby it may be raised to provide access to storage area 136. This area provides storage for a portable first aid kit 138 and a 12 volt battery 140. Attached to the inside of storage area 136 is a switch 142 through which all power to the inner sleigh is carried. This switch when in the off position cuts all power to the patient area as when oxygen is being administered, thus reducing the possibility of combustion in that area. Attached to the front of seat means 112 below seat 120 is control unit 144 which has a number of switches 146 and button 148. Switches 146, upon appropriate respective switch operation by an attendant, control the lights, namely interior lights 94, side and taillights 124, 126, antenna light 134, the heating mattress when in use. Pushing button 148 activates horn 74 so that the attendant may attract the attention of the driver of the towing vehicle. Control unit 144 also contains buzzer means which may be actuated by a patient via call button means 100.

It will be appreciated that the above electrically operated devices are suitably wired to battery 140 providing the appropriate power source for these devices subject to master control switch 142. The wires would be suitably run along the frame members 18, 20 out of the way and out of contact during normal use of the sleigh. Further it will be appreciated that in the event that an attendant, although preferred, is not present in a particular situation, the rescue sleigh is equipped with electrical circuit means whereby the call button means 100 may be switched to include activation of horn 74 so that a patient himself could signal directly the operator of a towing snowmobile. Battery 140 may be recharged by either one of two ways (not shown). It may be attached to a 110 cycle recharging unit after each trip or it may, through appropriate wiring, be connected to an alternator in the traction vehicle for recharging during operation of the vehicle.

Sleigh 10 is preferably also provided with suction unit 150 which is removably carried in box 152 of plywood and transparent plastic construction which box is secured by clips 153 to support 22. Unit 150 may be employed as required by an attendant during transport to suction a patient. The unit 150 is however easily removable with the box 152 so that it may be carried to a patient elsewhere. Unit 150 has its own rechargeable batteries and it may be powered or recharged by battery 140 through an appropriate electrical connection therewith (not shown).

Secured to the top of frame member 18 is a separate box structure 156 in which is carried a two way radio. The radio may have a self contained power supply. It will be appreciated however that the radio could be powered by battery 140 through an appropriate electrical connection therewith (not shown).

Figure 3:
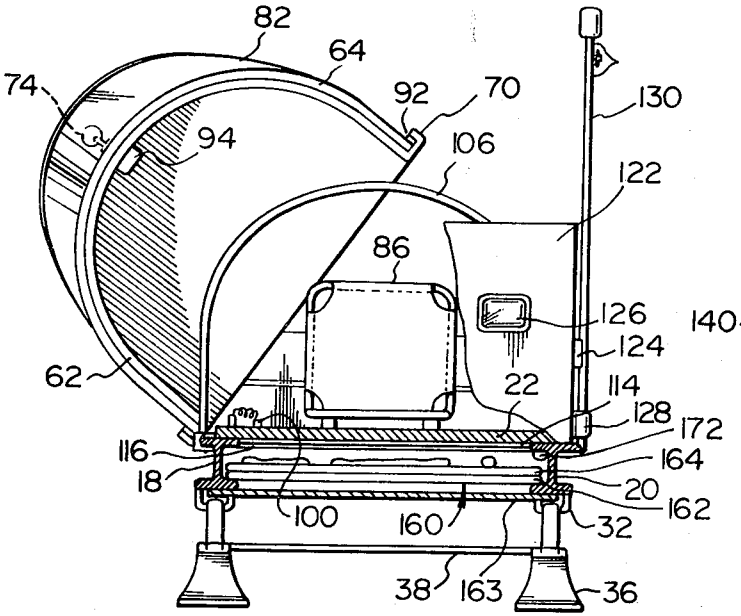
FIG. 3 is a fragmental rear sectional view taken along line 3—3 of FIG. 2.

As shown in FIG. 3, frame members 18, 20, being of "I" beam construction, provide for a storage area 160 under the sleigh 10. Storage area 160 is closed on both sides by the I beams 18 and 20 and area 160 is closed at its forward end and along the bottom by sheet material such as a sheet of aluminum 163 attached to the bottom flanges of the I beams 18 and 20 by suitable metal screws along the sides and attached at the forward end by screws to the bottom surface of support 22. The storage area 160 is rearwardly open to allow passage of fracture board 162 and an equipment board 164. The enclosed storage area 160 provides protection from snow and the like of the bottom of the sleigh as well as equipment including the fracture and equipment boards carried in the storage area. Equipment board 164 rests on top of fracture board 162 during transport. Detachably secured to equipment board 164 in a laid-out manner are equipment items such as leg splints (full), (half), arm splints, shovel, axe, flares and a flashlight.

Fracture board 162 and equipment board 164 are inserted and removed from storage area 160 rearwardly under attendant seat means 112.

Figure 4:
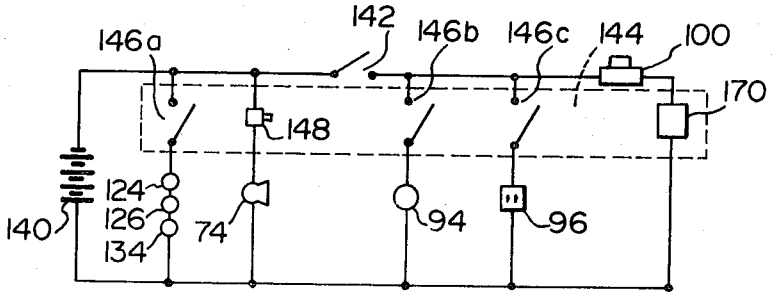
FIG. 4 is a schematic view of the electrical wiring for the rescue unit.

FIG. 4 is a schematic diagram of the wiring for the rescue unit, wherein switch 142 may be activated to cut all power from battery 140 to the various devices electrically associated with the battery contained within the patient section 14 of the sleigh. Control unit 144 (shown in dotted lines in FIG. 4) has switches 146 and buzzer button 148. Switches **146*a* control the various lights, taillights 126, side lights 124 and antenna light 134. Switch 146*b* controls interior light 94 and switch 146*c* controls the female socket 96 for the electric heating element of the stretcher mattress. Button means 148 controls activation of horn 74 and patient call button means 100 activates buzzer 170 which is housed within unit 144. It will be appreciated that the current may be suitably modified to place the various lights 124, 126, 128 on individual circuits and additional socket outlets and associates switches may be incorporated into the circuit for the purposes of selectively operating the radio 156 and/or the suction unit 150. Further, for the purposes of recharging battery 140, a suitable covered terminal outlet (not shown) could be associated with the back or side of the backrest 122 for convenience. The wiring for the various forwardly located electrical elements may be suitably located along one of the I beams (see 172, FIG. 3) and branch off therefrom as required. If the various electrical elements were to be electrically connected to the towing vehicle, the circuit of FIG. 4 would be suitably modified to bypass battery 140, the input wiring extending from a suitable socket means (not shown) adjacent hitch 40** in accordance with conventional practices in the towing art.

Accordingly the invention as described in detail herein provides a rescue unit of the ambulance type which enables any community having a snowmobile to feel confident that in the event more conventional rescue vehicles are not available for use due to climatic conditions, rescue and transport of injured and sick persons is still assured. Patients can be reached over terrain and during winter conditions which prohibit the use of other modes of conveyance. More importantly the unit of this invention permits first aid and equipment to be transported to the injured or sick person and after treatment such person can be transported to a road vehicle if desired or directly to a hospital.

During the detailed description of the preferred embodiment of the invention, reference has been made to various materials, such as plywood, aluminum, wire mesh, vinyl plastic canvas, styrofoam and carpeting. It will be appreciated that other suitable materials are equally contemplated within the concept of the invention. Further, the attachment of various parts to one another has been referred to and any suitable means such as welding, nut and bolt or adhesive is contemplated as the particular circumstances dictate.

It is contemplated that the rescue unit of this invention would be manned by experienced personnel. The unit permits the attendant to maintain a constant watch on the patient and the patient can, without much difficulty, be treated if necessary even when the unit is in motion. The attendant can easily slide canopy portion 64 as may be necessary or desirable to gain access to the patient under such circumstances.

It will also be appreciated that a wheeled transport support assembly could be used in lieu of the ski assembly 30 whereupon the unit would be adaptable for towing behind an all terrain vehicle or even a motor bike on paths not otherwise accessible to larger vehicles. Similarly a boat transport could be used in lieu of the ski assembly whereupon the unit would be adapted for marine use.

Although a preferred embodiment of the invention has heretofore been set forth, it will be apparent to those skilled in the art that various modifications may be made. The invention is not to be limited by the embodiment shown on the drawings and described above, which are given by way of example and not of limitation but only in accordance with the scope of the appended claims.

The embodiments of the invention in which an exclusive property or privilege is claimed are defined as follows:

1. A rescue unit adapted to be transported by a vehicle, comprising:

(a) frame means;

(b) transport assembly means attached to said frame means for permitting transport of the unit;

(c) a patient support section carried by said frame means and including cover means for said section, said cover means being movable to permit access to said patient support section;

(d) an attendant support section carried on said frame means longitudinally spaced from said patient support section in the direction of the head of a patient carried on said patient support section, (e) said cover means comprising a first portion and a second portion, said first portion being hingedly connected with one side of said frame means, means for limiting hinged open movement of said cover, and said second cover portion being telescopingly movable with respect to said first cover portion, (f) said second cover portion having a transparent section for association with a portion of the patient support section in the area of the head of a patient being carried on said unit, (g) said second cover portion carrying a transparent windscreen adjacent the transparent section and forward of the attendant support section, and (h) said attendant section including a transverse safety bar immediately rearwardly of said patient support section.

2. The rescue unit according to claim 1 wherein said attendant section includes seat means facing said patient support section and includes footrest means between said seat means and said patient support section.

3. A rescue unit adapted to be transported by a vehicle, comprising:

(a) frame means;

(b) transport assembly means attached to said frame means for permitting transport of the unit;

(c) a patient support section carried by said frame means and including cover means for said section, said cover means being movable to permit access to said patient support section;

(d) an attendant support section carried on said frame means longitudinally spaced from said patient support section in the direction of the head of a patient carried on said patient support section, (e) said cover means comprising a first portion and a second portion, said first portion being hingedly connected with one side of said frame means, means for limiting hinged open movement of said cover, and said second cover portion being telescopingly movable with respect to said first cover portion, (f) said second cover portion having a transparent section for association with a portion of the patient support section in the area of the head of a patient being carried on said unit, (g) said attendant section including seat means facing said patient support section and including footrest means between said seat means and said patient support section, and (h) said seat means including backrest means and a hinged seat, said seat means having a storage area accessible through said hinged seat.

4. A rescue unit adapted to be transported by a vehicle, comprising:

(a) frame means;

(b) transport assembly means attached to said frame means for permitting transport of the unit;

(c) a patient support section carried by said frame means and including cover means for said section, said cover means being movable to permit access to said patient support section;

(d) an attendant support section carried on said frame means longitudinally spaced from said patient support section in the direction of the head of a patient carried on said patient support section, (e) said cover means comprising a first portion and a second portion, said first portion being hingedly connected with one side of said frame means, means for limiting hinged open movement of said cover, and said second cover portion being telescopingly movable with respect to said first cover portion, (f) said second cover portion having a transparent section for association with a portion of the patient support section in the area of the head of a patient being carried on said unit, (g) said frame means comprising two I beams and said patient support section including a frame support secured to the upper flange surfaces of said I beams, cover means secured to the bottom flange surfaces of said I beams and defining with said frame support a storage area, and board means supported within said storage area and telescopingly removable therefrom below said patient support section and said attendant section.

5. The rescue unit according to claim 4 wherein said board means includes a fracture board and equipment board and said equipment board being telescopingly removable from said storage area separately from said fracture board.

6. The rescue unit according to claims 1, 3 or 4 wherein said patient support section includes a frame support covered by insulation and canvas means, said frame support having recess means adapted to accept support appendages of a stretcher on said patient support means.

7. The rescue unit according to claims 1, 3 or 4 further comprising means for supporting oxygen bottles and accessories related thereto.

8. The rescue unit according to claim 3 wherein said cover is internally insulated, light means internally associated with said first cover portion, and battery means within said seat storage area, means electrically connecting said light and battery means including switch means on the outside of said seat.

9. A rescue unit adapted to be transported by a vehicle, comprising:

(a) frame means;

(b) transport assembly means attached to said frame means for permitting transport of the unit;

(c) a patient support section carried by said frame means and including cover means for said section;

(d) an attendant support section carried on said frame means rearwardly of said patient support section and in the direction of the head of a patient carried on said patient support section;

(e) said cover means comprising a first portion and a second portion, said first portion being hingedly connected with said frame means;

(f) said second cover portion being movable with said first portion when said first portion is moved from a closed position to an open position to provide access to said patient support section, means for limiting hinged open movement of said cover means, said second portion further being in telescoping association with said first portion to provide selective access to the upper portion of a patient being carried on a moving rescue unit to an attendant; and (g) said support attendant section including seat means facing said patient support section and footrest means between said seat means and said patient support section, said attendant section further including attendant graspable safety means adjacent said second cover portion.

10. The rescue unit according to claim 9 wherein said seat means includes backrest means and hinged seat, said seat means having a storage area accessible through said hinged seat.

11. The rescue unit according to claim 9 wherein said second cover portion has a transparent section for association with a portion of the patient support section in the area of the head of a patient being carried on said unit.

12. The rescue unit according to claim 11 wherein said second cover portion carries a transparent windscreen adjacent the transparent section and forward of the attendant support section.

13. The rescue unit according to claim 9 wherein said frame means comprises two I beams and said patient support section includes a frame support secured to the upper flange surfaces of said I beams, cover means secured to the bottom flange surfaces of said I beam and defining with said frame support a storage area, board means supported within said storage area and telescopingly removable therefrom below said patient support section and said attendant section.

14. The rescue unit according to claim 13 wherein said board means includes a fracture board and equipment board and said equipment board being telescopingly removable from said storage area separately from said fracture board.

15. The rescue unit according to claim 9 wherein said patient support section includes a frame support covered by insulation and canvas means, said frame support having recess means adapted to accept support appendages of a stretcher on said patient support means.

16. The rescue unit according to claim 10 wherein said cover is internally insulated, light means internally associated with said first cover portion, and battery means within said seat storage area, means electrically connecting said light and battery means including switch means on the outside of said seat.

* * * * *